US011953241B2

(12) United States Patent
Tung et al.

(10) Patent No.: US 11,953,241 B2
(45) Date of Patent: Apr. 9, 2024

(54) CONDENSER AND OPEN LOOP TWO PHASE COOLING SYSTEM

(71) Applicants: Inventec (Pudong) Technology Corporation, Shanghai (CN); INVENTEC CORPORATION, Taipei (TW)

(72) Inventors: Kai-Yang Tung, Taipei (TW); Hung-Ju Chen, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 42 days.

(21) Appl. No.: 17/839,780

(22) Filed: Jun. 14, 2022

(65) Prior Publication Data

US 2023/0070643 A1 Mar. 9, 2023

(30) Foreign Application Priority Data

Sep. 6, 2021 (CN) ..... 202111038055.8
Sep. 6, 2021 (CN) ..... 202111039333.1

(51) Int. Cl.
*F25B 39/04* (2006.01)

(52) U.S. Cl.
CPC ..... *F25B 39/04* (2013.01)

(58) Field of Classification Search
CPC ..... F25B 39/04; F25B 23/006; F28B 1/06; F28F 13/182; F28F 13/187; F28F 2009/226; F28F 1/025; F28F 1/06; F28F 1/08; F28F 9/16; F28F 9/18; F28D 1/05316
See application file for complete search history.

(56) References Cited

U.S. PATENT DOCUMENTS

2021/0260966 A1* 8/2021 Walter ..... F25B 39/04
2021/0348820 A1* 11/2021 Kobayashi ..... F25B 25/005

FOREIGN PATENT DOCUMENTS

GB 1297941 A * 11/1972 ..... F28D 7/16

OTHER PUBLICATIONS

Pdf is original document of foreign reference GB-1297941-A (Year: 1972).*
Pdf is original document of foreign reference (Year: 1972).*

* cited by examiner

*Primary Examiner* — Len Tran
*Assistant Examiner* — Kamran Tavakoldavani
(74) *Attorney, Agent, or Firm* — Locke Lord LLP; Tim Tingkang Xia, Esq.

(57) ABSTRACT

A condenser includes a casing and pipes. The casing includes an inlet chamber, an outlet chamber, a first inlet, a first outlet, an accommodation space, a second inlet, and a second outlet. The first inlet and the first outlet are respectively in fluid communication with the inlet chamber and the outlet chamber. The accommodation space accommodates a coolant, and the second inlet and the second outlet are in fluid communication with the accommodation space not in fluid communication with the inlet chamber and the outlet chamber. The pipes are in the accommodation space and connect the inlet chamber with the outlet chamber, and a working fluid flows from the inlet chamber to the outlet chamber via the pipes. The first inlet is located closer to the second outlet than the first outlet, and the first outlet is located closer to the second inlet than the first inlet.

12 Claims, 7 Drawing Sheets

CONDENSER AND OPEN LOOP TWO PHASE COOLING SYSTEM

CROSS-REFERENCE TO RELATED APPLICATIONS

This non-provisional application claims priority under 35 U.S.C. § 119(a) on Patent Application No(s). 202111039333.1 filed in China, on Sep. 6, 2021 and on Patent Application No(s). 202111038055.8 filed in China, on Sep. 6, 2021, the entire contents of which are hereby incorporated by reference.

BACKGROUND OF THE INVENTION

Technical Field of the Invention

The invention relates to a condenser and a cooling system, more particularly to a condenser and an open loop two phase cooling system.

Description of the Related Art

As technology rapidly progresses, especially in the era of increasing requirements of network, artificial intelligence, and cloud server, data center is required to process much more amount of data. In order to maintain or increasing the processing performance, it is necessary to constantly and effectively dissipate heat of the data center. However, the power density of the data center is high, such that the data center generates a large amount of heat while in operation. Therefore, the power and scale of the conventional heat dissipation devices are required to be increased to deal with heat, but this may also increase the power consumption, which increase the cost and the impact to the environment.

As a result, liquid cooling technique, such as immersion cooling, is widely used in recent years. The immersion cooling not only effectively dissipates heat of the data center in a low power consumption and cost manner, but also facilitates the size reduction of the data center. Specifically, the immersion cooling is to immerse heat sources of the data center, such as a motherboard and electronic components thereon, in a working fluid which is not electrically conductive, such that the heat generated by those heat sources can be rapidly absorbed by the working fluid, and there is no need to additionally dispose any active cooling device, such as fan. Therefore, immersion cooling increases the heat dissipation efficiency and facilitates the arrangement of hardware of the data center.

The more data the data center is required to process, the larger amount of heat the data center generates, and thus a present immersion cooling system uses a condenser to condense the working fluid in the immersion cooling system. The condenser generally uses a fan to generate an airflow to cool the gaseous working fluid in the condenser. However, such condenser having the fan is required to be large in size for effectively dissipate heat absorbed by the working fluid, but the large-sized condenser is difficult to be installed in a finite space of a rack. Therefore, only a condenser having a small size is available for the installation, which results in an issue of the insufficient heat dissipation efficiency.

SUMMARY OF THE INVENTION

The invention provides a condenser and an open loop two phase cooling system which have an improved heat dissipation efficiency of the condenser.

One embodiment of the invention provides a condenser. The condenser is configured to cool a working fluid via a coolant. The condenser includes a casing and a plurality of pipes. The casing includes an inlet chamber, an outlet chamber, a first inlet, a first outlet, an accommodation space, a second inlet, and a second outlet. The inlet chamber and the outlet chamber are respectively located at two opposite sides of the casing, the first inlet and the first outlet are respectively in fluid communication with the inlet chamber and the outlet chamber. The accommodation space is not in fluid communication with the inlet chamber and the outlet chamber, the accommodation space is configured to accommodate the coolant, and the second inlet and the second outlet are in fluid communication with the accommodation space. The pipes are disposed in the accommodation space. Two opposite ends of each of the pipes are respectively in fluid communication with the inlet chamber and the outlet chamber, and the working fluid is configured to flow from the inlet chamber to the outlet chamber via the pipes. The first inlet is located closer to the second outlet than the first outlet, and the first outlet is located closer to the second inlet than the first inlet.

Another embodiment of the invention provides an open loop two phase cooling system. The open loop two phase cooling system includes at least one heat exchange unit, a condenser, a tank, a control valve, and a pump. The condenser is in fluid communication with the heat exchange unit and configured to cool a working fluid via a coolant. The tank is in fluid communication with the heat exchange unit. The control valve is in fluid communication with the condenser. The pump is in fluid communication with the tank. The condenser includes a casing and a plurality of pipes. The casing includes an inlet chamber, an outlet chamber, a first inlet, a first outlet, an accommodation space, a second inlet, and a second outlet. The inlet chamber and the outlet chamber are respectively located at two opposite sides of the casing, the first inlet and the first outlet are respectively in fluid communication with the inlet chamber and the outlet chamber. The accommodation space is not in fluid communication with the inlet chamber and the outlet chamber, the accommodation space is configured to accommodate the coolant, and the second inlet and the second outlet are in fluid commmunication with the accommodation space. The pipes are disposed in the accommodation space. Two opposite ends of each of the pipes are respectively in fluid communication with the inlet chamber and the outlet chamber, and the working fluid is configured to flow from the inlet chamber to the outlet chamber via the pipes. The first inlet is located closer to the second outlet than the first outlet, and the first outlet is located closer to the second inlet than the first inlet.

According to the condenser and the open loop two phase cooling system as discussed in the above embodiments, the first inlet is located closer to the second outlet than the first outlet, and the first outlet is located closer to the second inlet than the first inlet, such that the coolant and the working fluid can respectively flow in the accommodation space and the pipes along two opposite directions. Therefore, the temperature difference between the coolant and the working fluid can be ensured to increase the heat exchange efficiency between the coolant and the working fluid.

According to the condensers and the open loop two phase cooling system as discussed in the above embodiments, since the volume of the gaseous working fluid is greater than that of the liquid working fluid, by designing the diameter of the first inlet to be greater than the diameter of the first outlet can increase the heat dissipation performance of the condenser.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1:
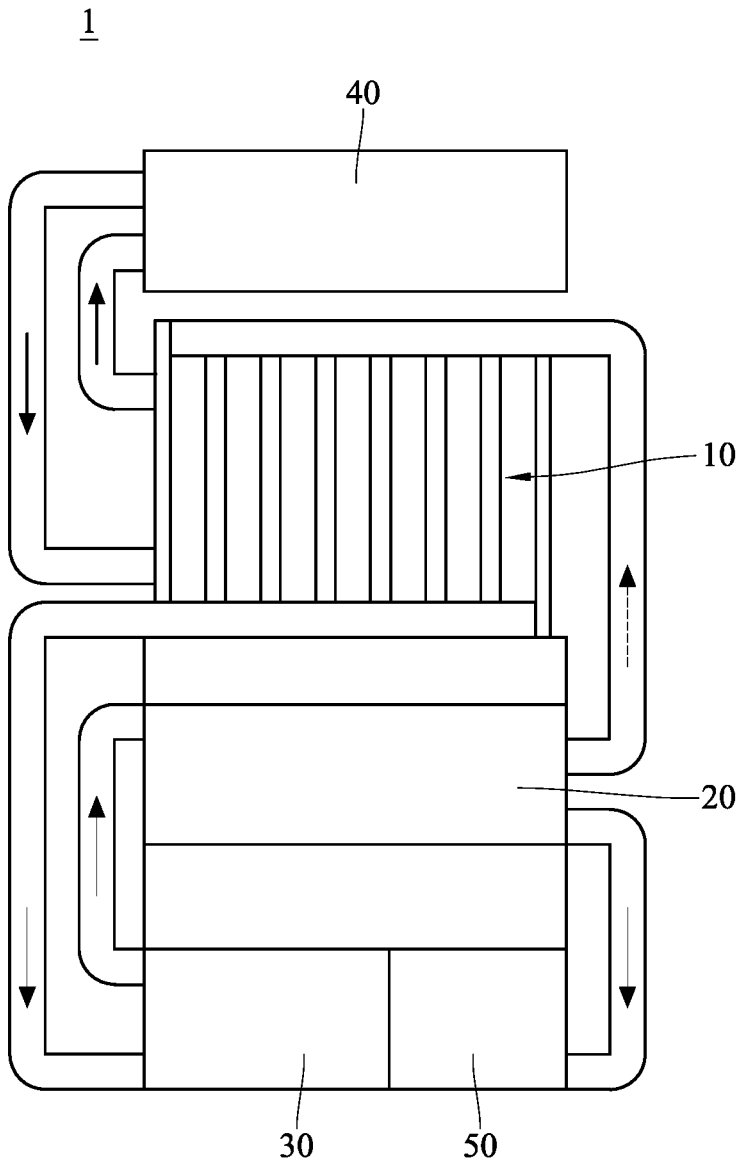
FIG. 1 is a schematic view of an open loop two phase cooling system having a condenser according to a first embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present invention, such as technical and scientific terms, have its own meanings and can be comprehended by those skilled in the art, unless the terms are additionally defined in the present invention. That is, the terms used in the following paragraphs should be read on the meaning commonly used in the related fields and will not be overly explained, unless the terms have a specific meaning in the present invention.

Refer to FIG. 1, where FIG. 1 is a schematic view of an open loop two phase cooling system 1 having a condenser 10 according to a first embodiment of the invention. The condenser 10 is applied in an open loop two phase cooling system 1. In this embodiment, the open loop two phase cooling system 1 includes the condenser 10, a heat exchange unit 20, a tank 30, a control valve 40, and a pump 50.

The condenser 10, the heat exchange unit 20, the tank 30, and the pump 50 are in fluid communication with one another, and a working fluid (not shown) can sequentially flow through the heat exchange unit 20, the condenser 10, the tank 30, and the pump 50 so as to complete a first cooling circulation. The condenser 10 is in fluid communication with the control valve 40, and a coolant (not shown) can sequentially flow through the condenser 10 and the control valve 40 so as to complete a second cooling circulation.

Figure 2:
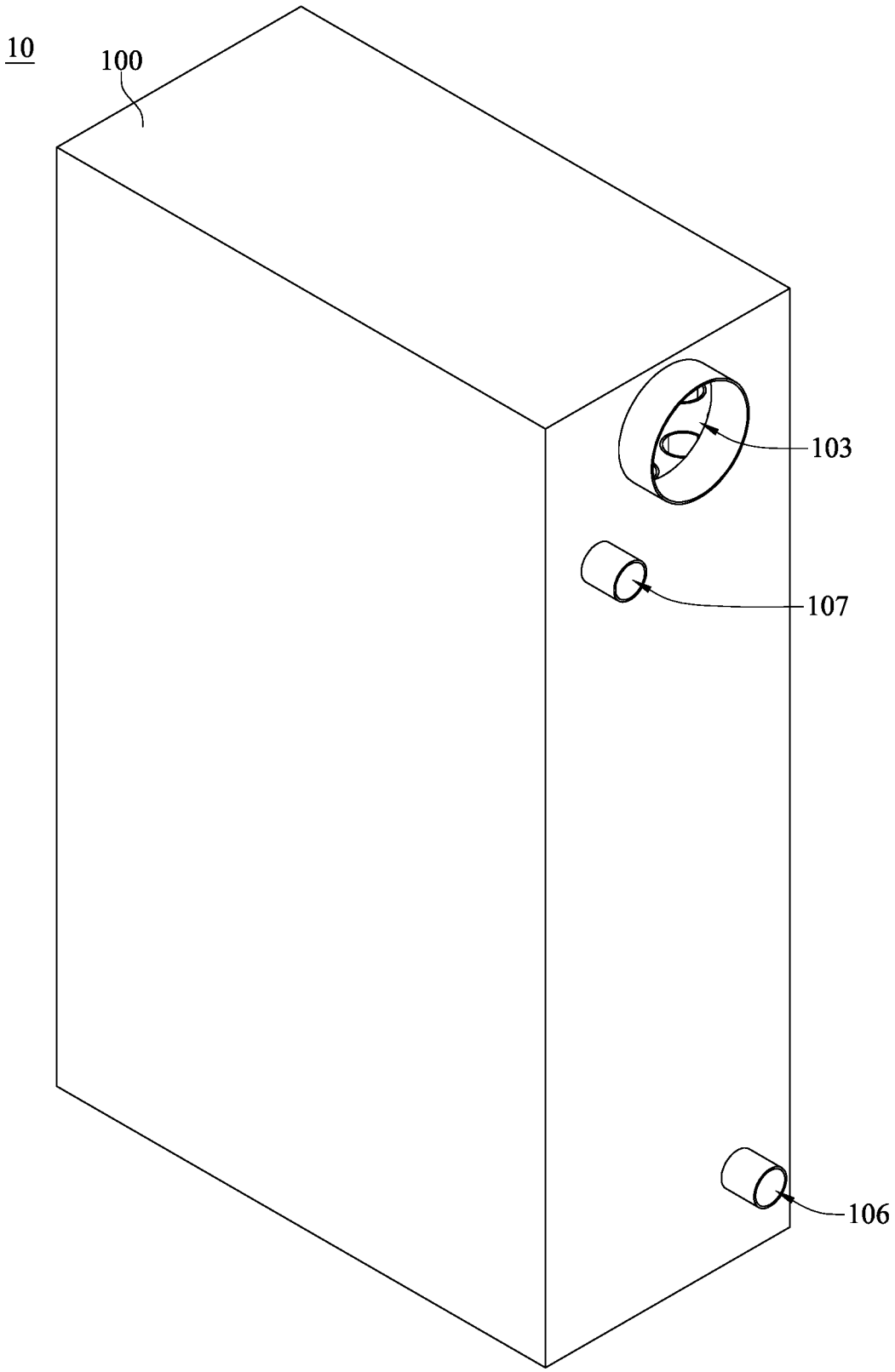
FIG. 2 is a perspective view of the condenser in FIG. 1.
Figure 3:
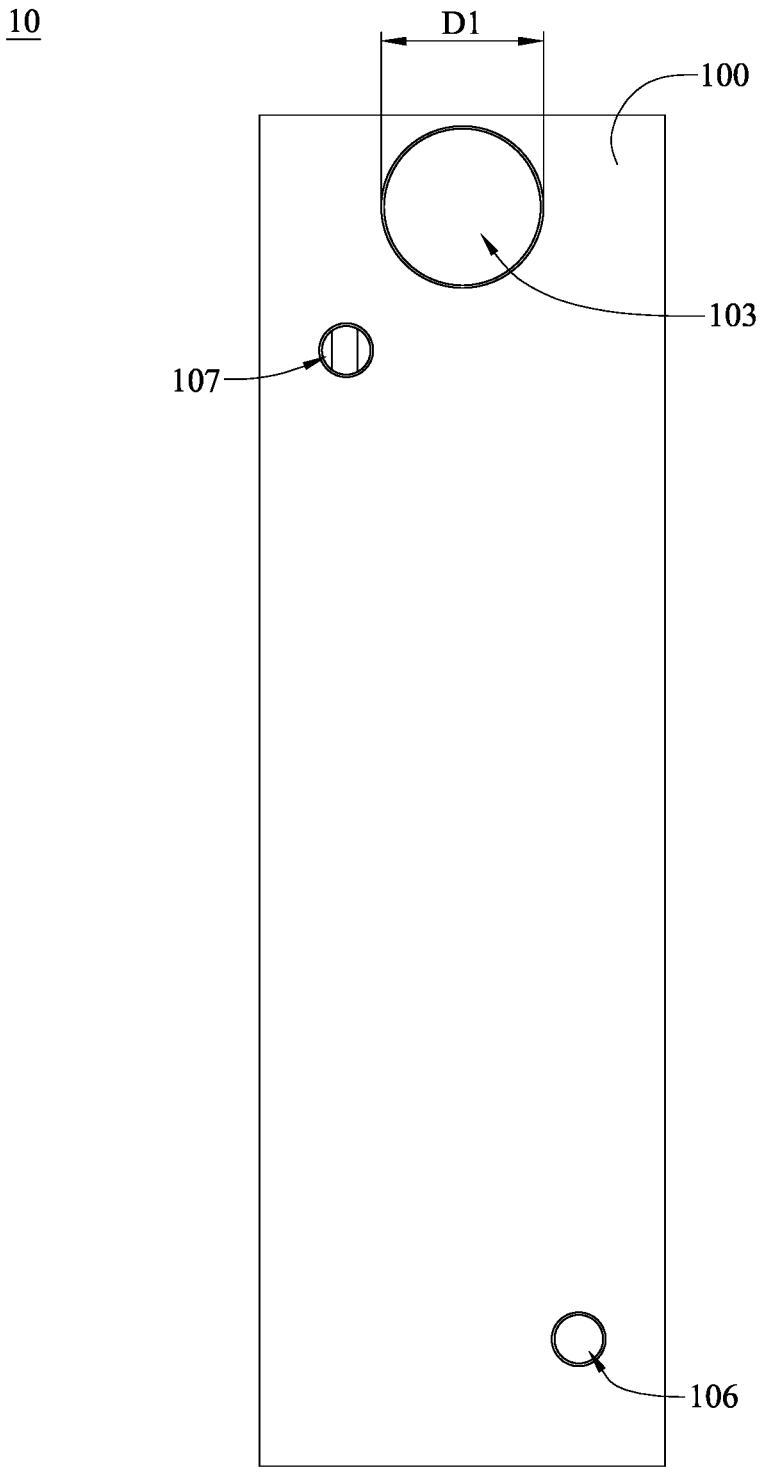
FIG. 3 is a side view of the condenser in FIG. 2.
Figure 4:
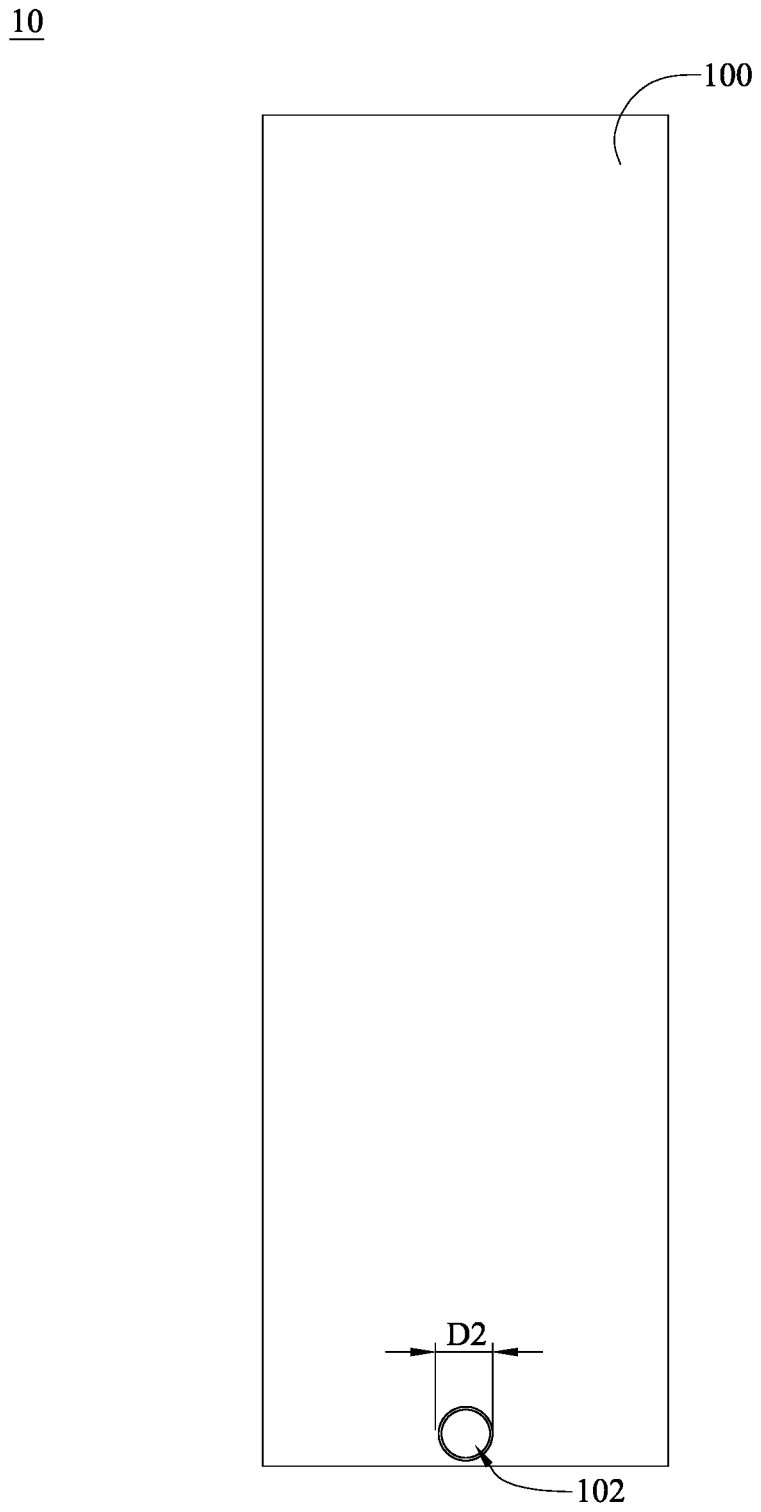
FIG. 4 is another side view of the condenser in FIG. 2.
Figure 5:
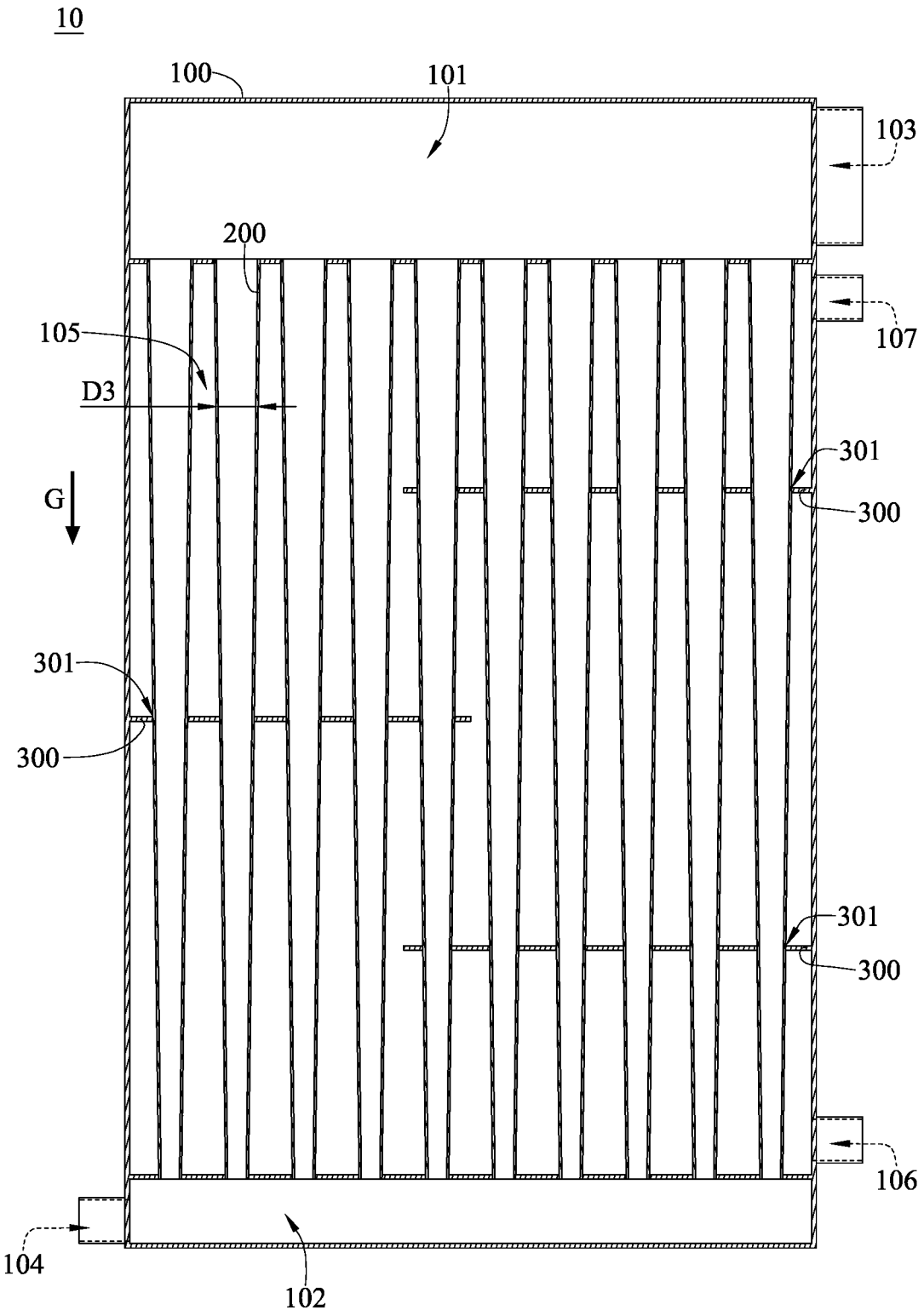
FIG. 5 is a cross-sectional view of the condenser in FIG. 2.

Refer to FIGS. 2 to 5, where FIG. 2 is a perspective view of the condenser 10 in FIG. 1, FIG. 3 is a side view of the condenser 10 in FIG. 2, FIG. 4 is another side view of the condenser 10 in FIG. 2, and FIG. 5 is a cross-sectional view of the condenser 10 in FIG. 2.

The condenser 10 is configured to cool the working fluid (not shown) via the coolant (not shown). The coolant is, for example, water, and the working fluid is, for example, a dielectric fluid. In this embodiment, the condenser 10 includes a casing 100, a plurality of pipes 200, a plurality of baffles 300, and a plurality of capillary structures 400.

In this embodiment, the casing 100 includes an inlet chamber 101, an outlet chamber 102, a first inlet 103, a first outlet 104, an accommodation space 105, a second inlet 106, and a second outlet 107. The inlet chamber 101 and the outlet chamber 102 are respectively located at two opposite sides of the casing 100. The first inlet 103 and the first outlet 104 are respectively in fluid communication with the inlet chamber 101 and the outlet chamber 102.

In addition, a diameter D1 of the first inlet 103 is greater than a diameter D2 of the first outlet 104. Therefore, a difference between a speed of the gaseous working fluid flowing to the inlet chamber 101 from the first inlet 103 and a speed of the liquid working fluid flowing out of the outlet chamber 102 from the first outlet 104 can be decreased, so that the cooling efficiency of the coolant to the working fluid can be improved, and the size of the condenser 10 can be reduced.

In addition, in this embodiment, in a direction G of gravity, the first inlet 103 is located above the first outlet 104, such that it facilitates the recycling of the liquid working fluid flowing out of the condenser 10 from the first outlet 104.

Moreover, the first inlet 103 is located closer to the second outlet 107 than the first outlet 104, and the first outlet 104 is located closer to the second inlet 106 than the first inlet 103.

The accommodation space 105 is not in fluid communication with the inlet chamber 101 and the outlet chamber 102, and the accommodation space 105 is configured to accommodate the coolant. The second inlet 106 and the second outlet 107 are in fluid communication with the accommodation space 105.

The pipes 200 are disposed in the accommodation space 105. Two opposite ends of each of the pipes 200 are respectively in fluid communication with the inlet chamber 101 and the outlet chamber 102. The working fluid is configured to flow from the inlet chamber 101 to the outlet chamber 102 via the pipes 200. Furthermore, in this embodiment, each of the pipes 200 has a diameter D3 which gradually decreases from one end thereof in fluid communication with the inlet chamber 101 to another end thereof in fluid communication with the outlet chamber 102, such that a difference between a speed of the gaseous working fluid and a speed of the liquid working fluid in the pipes 200 can be reduced, thereby increasing the recycling efficiency of the working fluid. In some other embodiments, each of the pipes may have a constant diameter from one end thereof in fluid communication with the inlet chamber to another end thereof in fluid communication with the outlet chamber.

In this embodiment, the baffles 300 are fixed to the casing 100 and located in the accommodation space 105, such that the coolant can be maintained in the accommodation space 105 much longer, thereby increasing the heat exchange efficiency between the working fluid and the coolant. In this embodiment, each of the baffles 300 has a plurality of through holes 301. At least some of the pipes 200 are respectively disposed through the through holes 301 of each baffle 300. Moreover, the baffles 300 are misaligned from one another so as to increase the time that the coolant is held in the accommodation space 105. In some other embodiments, the baffles may not be misaligned with one another. In another embodiment, the baffles may not have any through hole and may be directly fixed to outer surfaces of the pipes. In still another embodiment, the condenser may not include the baffles 300.

Figure 6:
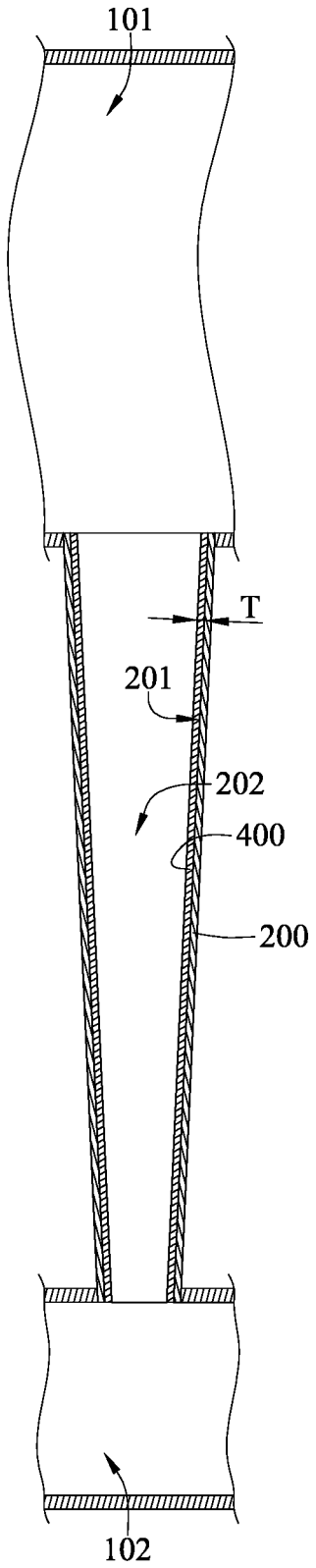
FIG. 6 is a schematic cross-sectional view of a pipe and a capillary structure of the condenser in FIG. 2.

Refer to FIG. 6, FIG. 6 is a schematic cross-sectional view of one pipe 200 and one capillary structure 400 of the condenser 10 in FIG. 2. In this embodiment, the capillary structures 400 are respectively disposed in the pipes 200, the following description takes one pipe 200 and one capillary structure 400 therein for detailed introduction, and the remaining of them are the same in structure and thus not further introduced. The capillary structure 400 is disposed on an inner surface 201 of the pipe 200 and surrounds a vapor channel 202 in the pipe 200. In the pipe 200, the gaseous working fluid mainly flows along the vapor channel 202, and the liquid working fluid mainly flows along the capillary structure 400. The capillary structure 400 assists the liquid working fluid flowing towards the outlet chamber 102 from the pipe 200 and thus facilitates the recycling of the working fluid. In this embodiment, the capillary structure 400 extends from one end of the pipe 200 in fluid communication with the inlet chamber 101 to another end of the pipe 200 in fluid communication with the outlet chamber 102, and the capillary structure 400 has a constant thickness T relative to the inner surface 201 of the pipe 200 from one end thereof located closer to the inlet chamber 101 to another end thereof located closer to the outlet chamber 102, but the present invention is not limited thereto.

Figure 7:
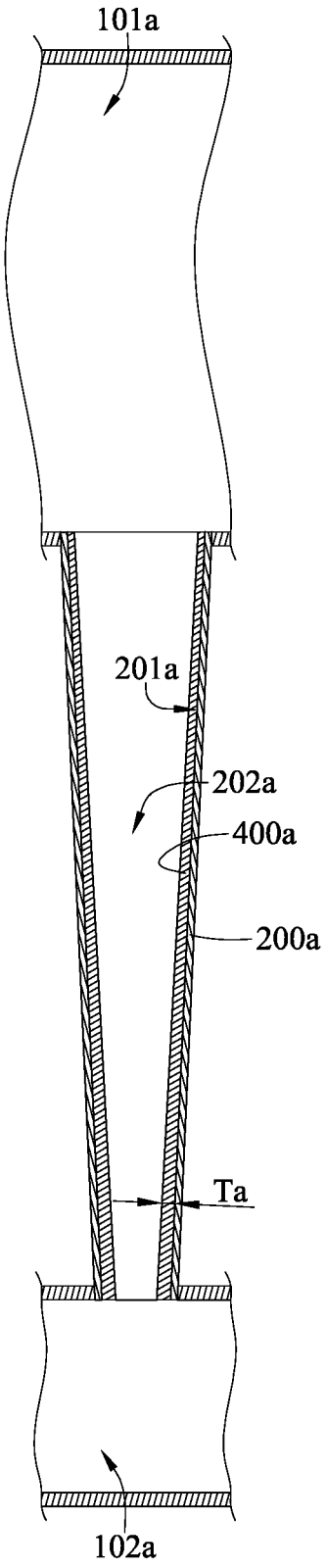
FIG. 7 is a schematic cross-sectional view of a pipe and a capillary structure of a condenser according to a second embodiment of the invention.

Refer to FIG. 7, where FIG. 7 is a schematic cross-sectional view of a pipe 200*a* and a capillary structure 400*a* of a condenser according to a second embodiment of the invention. In this embodiment, in each pipe 200*a*, the capillary structure 400*a* has a thickness Ta gradually increasing, relative to an inner surface 201*a* of the pipe 200*a*, from one end thereof located closer to an inlet chamber 101*a* to another end thereof located closer to an outlet chamber 102*a*. Therefore, a vapor channel 202*a* surrounded by the capillary structure 400*a* tapers from one end thereof located closer to the inlet chamber 101*a* to another end thereof located closer to the outlet chamber 102*a*. Accordingly, a difference between a speed of the gaseous working fluid and a speed of the liquid working fluid in the pipe 200*a* can be further reduced, thereby increasing the recycling efficiency of the working fluid.

According to the condensers and the open loop two phase cooling system as discussed in the above embodiments, the first inlet is located closer to the second outlet than the first outlet, and the first outlet is located closer to the second inlet than the first inlet, such that the coolant and the working fluid can respectively flow in the accommodation space and the pipes along two opposite directions. Therefore, the temperature difference between the coolant and the working fluid can be ensured to increase the heat exchange efficiency between the coolant and the working fluid.

According to the condensers and the open loop two phase cooling system as discussed in the above embodiments, since the volume of the gaseous working fluid is greater than that of the liquid working fluid, by designing the diameter of the first inlet to be greater than the diameter of the first outlet can increase the heat dissipation performance of the condenser.

In one embodiment of the invention, the condenser disclosed by the invention can be applied to a server, and the server may be applied to artificial intelligence (AI) computing, edge computing and can be used as 5G server, cloud computing server, or vehicle internet server.

It will be apparent to those skilled in the art that various modifications and variations can be made to the present invention. It is intended that the specification and examples be considered as exemplary embodiments only, with a scope of the invention being indicated by the following claims and their equivalents.

What is claimed is:

1. A condenser, configured to cool a working fluid via a coolant, the condenser comprising:

a casing, comprising an inlet chamber, an outlet chamber, a first inlet, a first outlet, an accommodation space, a second inlet, and a second outlet, wherein the inlet chamber and the outlet chamber are respectively located at two opposite sides of the casing, the first inlet and the first outlet are respectively in fluid communication with the inlet chamber and the outlet chamber, the accommodation space is not in direct fluid communication with the inlet chamber and the outlet chamber, the accommodation space is configure to accommodate the coolant, and the second inlet and the second outlet are in fluid communication with the accommodation space; and a plurality of pipes, disposed in the accommodation space, wherein two opposite ends of each of the plurality of pipes are respectively in fluid communication with the inlet chamber and the outlet chamber, and the working fluid is configured to flow from the inlet chamber to the outlet chamber via the plurality of pipes;

wherein the first inlet is located closer to the second outlet than the first outlet, and the first outlet is located closer to the second inlet than the first inlet;

wherein the condenser further comprises a plurality of capillary structures, and the plurality of capillary structures are respectively disposed in the plurality of pipes.

2. The condenser according to claim 1, further comprising at least one baffle, wherein the at least one baffle is fixed to the casing and located in the accommodation space.

3. The condenser according to claim 2, wherein the at least one baffle has a plurality of through holes, and at least some of the plurality of pipes are respectively disposed through the plurality of through holes.

4. The condenser according to claim 3, wherein the quantity of the at least one baffle is plural, and the baffles are misaligned from one another.

5. The condenser according to claim 1, wherein each of the plurality of capillary structures extends from one end of one of the plurality of pipes which is in fluid communication with the inlet chamber to another end thereof which is in fluid communication with the outlet chamber, and each of the plurality of capillary structures has a constant thickness from one end thereof located closer to the inlet chamber to another end thereof located closer to the outlet chamber.

6. The condenser according to claim 1, wherein each of the plurality of capillary structures extends from one end of one of the plurality of pipes which is in fluid communication with the inlet chamber to another end thereof which is in fluid communication with the outlet chamber, and each of the plurality of capillary structures has a thickness which gradually increases from one end thereof located closer to the inlet chamber to another end thereof located closer to the outlet chamber.

7. The condenser according to claim 1, wherein a diameter of the first inlet is greater than a diameter of the first outlet.

8. The condenser according to claim 1, wherein each of the plurality of pipes has a diameter which decreases from one end thereof located closer to the inlet chamber to another end thereof located closer to the outlet chamber.

9. The condenser according to claim 1, wherein in a direction of gravity, the first inlet of the casing is located above the first outlet of the casing.

10. An open loop two phase cooling system, comprising:

at least one heat exchange unit;

a condenser, in fluid communication with the at least one heat exchange unit and configured to cool a working fluid via a coolant;

a tank, in fluid communication with the at least one heat exchange unit;

a control valve, in fluid communication with the condenser; and a pump, in fluid communication with the tank;

wherein the condenser comprises:

a casing, comprising an inlet chamber, an outlet chamber, a first inlet, a first outlet, an accommodation space, a second inlet, and a second outlet, wherein the inlet chamber and the outlet chamber are respectively located at two opposite sides of the casing, the first inlet and the first outlet are respectively in fluid communication with the inlet chamber and the outlet chamber, the accommodation space is not in fluid communication with the inlet chamber and the outlet chamber, the accommodation space is configured to accommodate the coolant, and the second inlet and the second outlet are in fluid communication with the accommodation space; and a plurality of pipes, disposed in the accommodation space, wherein two opposite ends of each of the plurality of pipes are respectively in fluid communication with the inlet chamber and the outlet chamber, and the working fluid is configured to flow from the inlet chamber to the outlet chamber via the plurality of pipes;

wherein the first inlet is located closer to the second outlet than the first outlet, and the first outlet is located closer to the second inlet than the first inlet;

wherein the open loop two phase cooling system further comprises a plurality of capillary structures, and the plurality of capillary structures are respectively disposed in the plurality of pipes.

11. The open loop two phase cooling system according to claim 10, further comprising at least one baffle, wherein the at least one baffle is fixed to the casing and located in the accommodation space.

12. The open loop two phase cooling system according to claim 10, wherein a diameter of the first inlet is greater than a diameter of the first outlet.

* * * * *